United States Patent [19]

Maeda et al.

[11] Patent Number: 4,964,371

[45] Date of Patent: Oct. 23, 1990

[54] AUTOMOBILE ENGINE COOLING SYSTEM

[75] Inventors: Toshimasa Maeda, Higashihiroshima; Hidenobu Sato, Hiroshima, both of Japan

[73] Assignee: Mazda Motor Corporation, Hiroshima, Japan

[21] Appl. No.: 333,018

[22] Filed: Apr. 4, 1989

[30] Foreign Application Priority Data

Apr. 4, 1988 [JP] Japan ..... 63-81430

[51] Int. Cl.[5] ..... F01P 7/14

[52] U.S. Cl. ..... 123/41.1; 123/41.13

[58] Field of Search ..... 123/41.07, 41.08, 41.09, 123/41.1, 41.13, 41.44; 236/34, 34.5

[56] References Cited

U.S. PATENT DOCUMENTS

| | | | |
|---|---|---|---|
| 1,306,000 | 6/1919 | Fulton et al. | 123/41.1 |
| 2,075,521 | 3/1937 | Hild | 123/41.13 |
| 2,622,572 | 12/1952 | Nallinger | 123/41.09 |
| 3,805,748 | 4/1974 | Garcea et al. | 123/41.1 |
| 4,011,988 | 3/1977 | Inagaki | 236/34.5 |
| 4,337,733 | 7/1982 | Hirata et al. | 123/41.1 |

FOREIGN PATENT DOCUMENTS

| | | | |
|---|---|---|---|
| 1365149 | 5/1964 | France | 123/41.1 |

*Primary Examiner*—Noah P. Kamen

*Attorney, Agent, or Firm*—Fleit, Jacobson, Cohn, Price, Holman & Stern

[57] ABSTRACT

A cooling system for an internal combustion engine has a water jacket connected to a radiator with upper and lower radiator passages for cooling coolant leaving the engine and a water pump in the lower radiator passage for circulating coolant through the water jacket. A bypass passage connects the upper radiator passage to the lower radiator passage for the circulation of coolant through the water jacket bypassing the radiator. A first thermostat valve in the upper radiator passage closes the upper radiator passage and opens the bypass passage when the coolant is lower than a predetermined low temperature and the engine is operated in a low engine load range so as to permit the circulation of coolant through the bypass passage bypassing the bypass passage. A second thermostat valve in the upper radiator passage opens the upper radiator passage and closes the bypass passage when the coolant is higher than a predetermined high temperature and the engine is operated with a rapid change of engine load so as to interrupt the circulation of coolant bypassing the bypass passage.

38 Claims, 3 Drawing Sheets

AUTOMOBILE ENGINE COOLING SYSTEM

FIELD OF THE INVENTION

The present invention relates to a cooling system for an internal combustion engines and more particularly to a vehicle engine cooling system which maintains a sufficiently high temperature of engine coolant under low load engine operating conditions by circulating the engine coolant through a radiator.

BACKGROUND OF THE INVENTION

An internal combustion engine has been developed with high operating efficiency obtained by means of an improved cooling system in which circulation of the engine coolant through the engine is carried out by using a water pump of which the water outlet is communicated with a water jacket of the engine and the engine coolant inlet is communicated with an outlet tank of the radiator. A bypass, which allows the engine coolant to reenter the water pump, is provided between the thermostat valve and the water inlet of the water pump. Such a cooling system is disclosed in, for example, Japanese Unexamined Utility Model Publication No. 57-30,322 entitled "Engine Cooling System For Engines" laid open Feb. 17, 1982.

To increase fuel mileage or decrease fuel consumption in low engine load range, it was taught that a high range thermostat that starts opening near 82° C. (179.6° F.) and is fully open around 100° C. (212° F.) can be used. When the high range pellet thermostat is used, the engine coolant flows through the bypass being kept away from passing the radiator below an engine coolant temperature of around 100° C., whereby the engine operating temperature is maintained high, so as to contribute to an increase of fuel mileage in the low engine load range.

Such a cooling system is, however, apt to keep the engine coolant away from passing through the radiator when the engine load rapidly changes from low to high. Circulating a high temperature of engine coolant through the engine results in a lowering in cooling efficiency and decreases fuel mileage. On the other hand, if the engine load rapidly changes from high to low, the engine coolant becomes too cool before the thermostat valve fully closes, so as to increase fuel mileage consumption and cause a problem of emission control.

SUMMARY OF THE INVENTION

The primary object of the present invention is to provide an internal combustion engine with a novel cooling system which is simple in structure, and can take advantage of fuel mileage.

The object of the present invention is achieved by a cooling system for an internal combustion engine having a radiator connected to an engine by way of circulation passages for cooling engine coolant leaving the engine and a water pump disposed in the circulation passage for circulating engine coolant through the engine. At least one bypass passage is provided to allow the engine coolant leaving the engine to reenter into the engine bypassing the radiator. First and second valve means are disposed in the circulation passage parallel to each other.

The first valve means is adapted to open at temperatures higher than a first predetermined opening temperature at which the first valve means starts opening while the engine is operated in high engine load range, and the second valve means is adapted to start opening at a second predetermined opening temperature higher than the first predetermined temperature for the first valve means. At least one bypass valve means closes at least one bypass passage at a temperature between the first and second predetermined opening temperatures for the first and second valve means.

The first valve means includes a first thermostat valve starting opening at the first predetermined opening temperature and the bypass valve is cooperated with the first thermostat valve to close a bypass passage having a largest crosssectional area while the first thermostat valve is opening. The first valve means further includes a valve located in series relative to the first thermostat valve in the circulation passage, the valve being operated by actuator means to close for interrupting the flow of engine coolant through the first thermostat valve when the engine is operated in low engine load range.

According to a preferred embodiment of the present invention, a first and second bypass passage branching off from the circulation passage is provided to allow engine coolant leaving the engine to reenter into the engine bypassing said radiator. A first and second bypass valve means are provided in cooperation with the first and second thermostat valves, respectively. The first bypass valve is caused to close the first bypass passage at a temperature between the first and second opening temperatures. The second bypass valve is caused to close the second bypass passage at a temperature higher than a temperature at which the first bypass valve is caused to close the first bypass passage.

BRIEF DESCRIPTION OF THE DRAWINGS

Still other objects of the invention and more specific features will become apparent to those skilled in the art from the following description of the preferred embodiment considered together with the accompanying drawings wherein like reference characters have been used in the different figures to denote the same parts and in which.

DETAILED DESCRIPTION OF INVENTION

Figure 1:
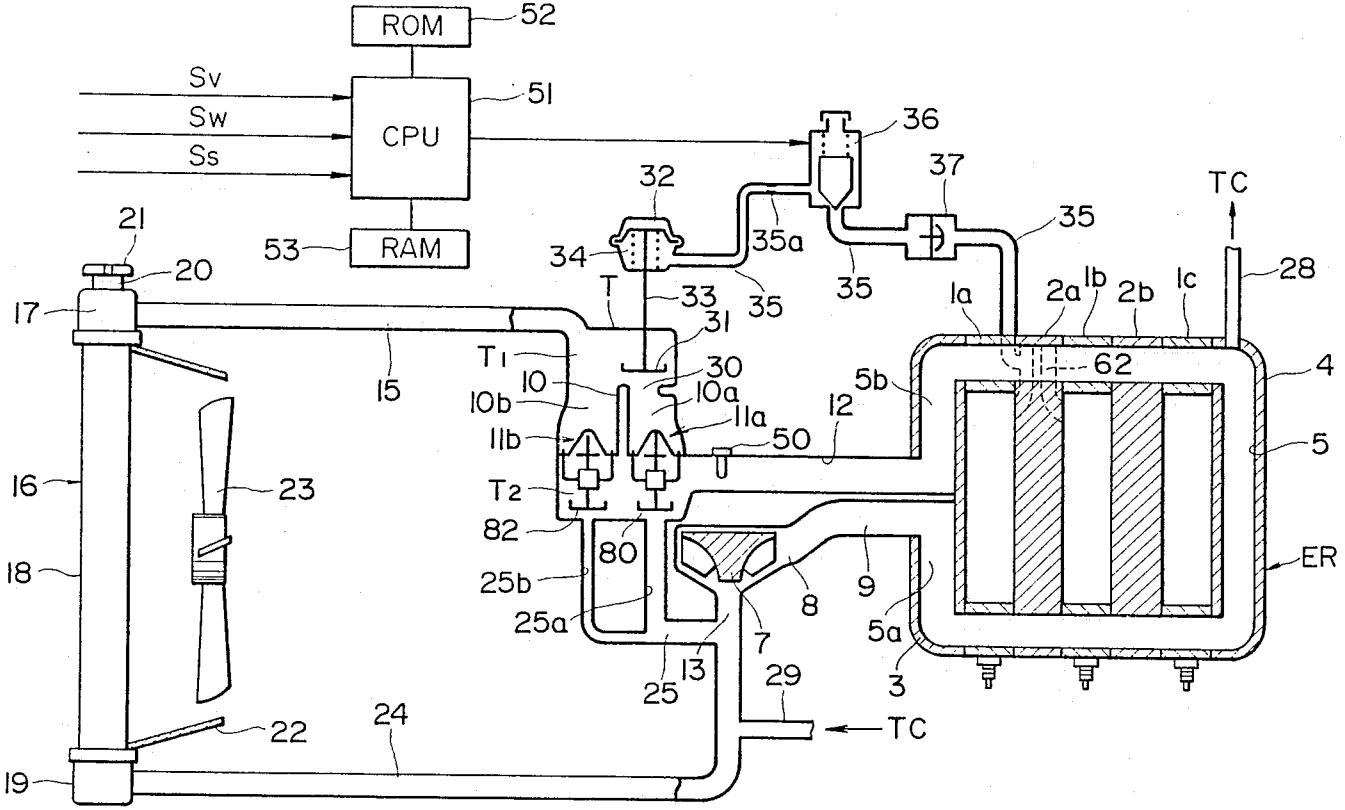
FIG. 1 is a schematic diagram of a cooling system in accordance with a preferred embodiment of the present invention.
Figure 2:
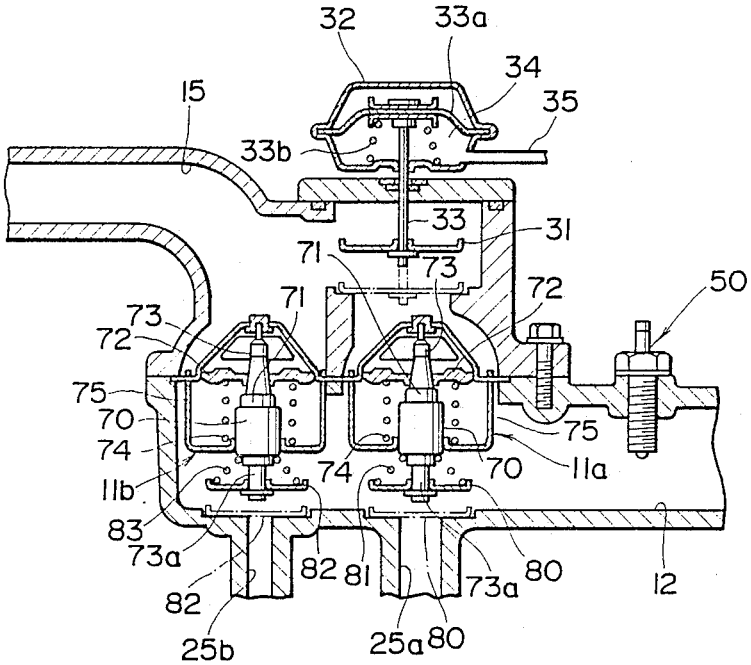
FIG. 2 is a cross-sectional view of a thermostat valve setup employed in the cooling system shown in FIG. 1.

Referring to the drawings in detail, particularly to FIGS. 1 and 2, an engine body ER of a triple-rotor rotary engine having a cooling system in accordance with the present invention is shown, consisting of first, second and third rotor housings 1*a*, 1*b* and 1*c* and first and second intermediate rotor 2*a* and 2*b*. The first intermediate rotor housing 2*a* is disposed between the first and second rotor housings 1*a* and 1*b*; and the second intermediate rotor housing 2*b* is disposed between the second and third rotor housing 1*b* and 1*c*. The rotary engine ER is provided with an front end housing 3 provided to cover the outer open end of the first rotor housing 1*a* and a rear end housing 4 provided to cover the outer open end of the third rotor housing 1*c*. These end housings 3 and 4 are hollow to form an engine coolant passage or water jacket 5 to permit the passage of engine coolant.

Engine coolant is introduced into the engine ER through an inlet area 5a of the water jacket 5 communicating with a water outlet 8 of a water pump 7 by way of an inlet passage 9, and leaves the engine ER through a hot area or outlet area 5b of the water jacket 5 communicating with a thermostat valve housing T of the cooling system by way of an outlet passage 12. These inlet and outlet passages 9 and 12 are arranged parallel to each other. The thermostat valve housing T is provided with lower range and higher range thermostat valves 11a and 11b disposed side by side and divides its interior into two spaces, upper space T1 and lower space T2. The thermostat valve housing T is further provided with a partition 10 located between the lower and higher range thermostat valves 11a and 11b to divide the upper space T1 into two parts so as to form laterally adjacent open ended thermostat valve chambers 10a and 10b which communicate with each other at their top ends.

A bypass passage 25 communicating with the water inlet 13 of the water pump 7 has first and second upstream branch bypass passages 25a and 25b . The first branch bypass passage 25a, which has a cross-sectional area substantially equal to that of the downstream part of the bypass passage 25, is connected to the thermostat valve housing T at a position right below the lower range thermostat valve 11a, thereby communicating with the outlet passage 12 through the lower space T2 of the thermostat valve housing T. The second branch bypass passage 25b, which has a cross-sectional area smaller that that of the downstream part of the bypass passage 25, and hence the first branch bypass passage 25a, is connected to the thermostat valve housing T at a position right below the higher range thermostat valve 11b, thereby communicating with the outlet passage 12 through the lower space T2 of the thermostat valve housing T.

As is shown in detail in FIG. 2, each thermostat valve 11a, 11b, which is a wax pellet thermostat valve in common use today, comprises a small cylindrical case 70 and a pellet 71 of copper impregmented or filled wax contained in the pellet case 70. The thermostat valve 11a, 11b further comprises a steel piston or pin 73 extending through the wax pellet 71, a pull-push valve 72 which is fixedly attached to the upper end of the steel piston 73, and a coil spring 74 disposed in an outer case 75 and surrounding cylinder case 70 containing the wax pellet 71 for urging the pull-push valve 72 upward. The lower and higher range thermostat valves 11a and 11b are placed in the outlet passage 12, so that the pellet case 70 rests in the engine coolant leaving from the engine ER. When the engine ER is cold, there is no pellet action and the spring 74 holds the pull-push valve 72 closed as seen in FIG. 2. As the engine coolant warms, the wax pellet 71 is heated. This causes the wax to expand and force a rubber (which is received within the wax pellet 71 and surrounding the steel piston 73) tightly against the steel piston 73. When the engine coolant temperature reaches the predetermined level, the wax will have expanded to the point that the pressure on the rubber is so great that it will force the pellet case 70 downward against the spring 74, thus pulling the pull-push valve 72 open and allowing engine coolant to flow through the thermostat valve 11a, 11b on into the upper radiator passage 15.

The lower range thermostat valve 11a is provided as auxiliary valve means in an attempt at preventing leakage of engine coolant possibly caused due to fluctuations of engine coolant pressure or vibrations of the engine ER when the temperature of engine coolant is relatively low and is, for this purpose, so designed as to start opening near 82° C. (179.6° F.) and is fully opened around 95° C. (203° F.). The remaining thermostat valve 11b is also a pellet wax thermostat but designed to start opening near 97° C. (206.6° C.) and is fully opened around 110° C. (230° F.).

The lower range thermostat valve 11a has a first bypass valve 80 slidably mounted on a lower piston end 73a of the steel piston 73. A coil spring 81, which has a spring force weaker than that of the coil spring 74 in the outer case 75 urging the pull-push valve 72 upward, surrounds the lower extension of the steel piston 73 between the bottom wall of the outer case 75 and the first bypass valve 80. The lower range thermostat valve 11a is also designed so as to make the first bypass valve 80 tightly close the branch bypass passage 25a around 87° C. (188.6° F.) five degrees higher than the opening temperature of 82° C. for the lower range thermostat valve 11a. That is, as the engine coolant warms, the wax pellet 71 is heated, which causes the wax gradually to expand and force the rubber tightly against the steel piston 73, so as to force the pellet case 70 downward against the coil spring 74, thus gradually pulling the pull-push valve 72 downward to open the lower range thermostat valve 11a and simultaneously pushing the first bypass valve 80 to close the first branch bypass passage 25a.

The higher range thermostat valve 11b is so designed as to start opening near 97° C. (206.6° F.) and is fully opened around 110° C. (230° F.). The higher range thermostat valve 11b has a second bypass valve 82 slidably mounted on the lower end 73a of the steel piston 73 of the lower range thermostat valve 11b. A coil spring 83, which has a spring force weaker than that of the coil spring 74 in the outer case 75 urging the pull-push valve 72 upward, surrounds the lower piston extension of the steel piston 73 between the bottom wall of the outer case 75 and the second bypass valve 82. The higher range thermostat valve 11b is also designed so as to make the bypass valve 82 tightly close the branch bypass passage 25b around 102° C. (215.6° F.) five degrees higher than the opening temperature of 97° C. for the higher range thermostat valve 11b. In the same way as in the low range thermostat valve 11a, as the engine coolant warms, the pellet case 70 is forced downward against the coil spring 74, thus gradually pulling the pull-push valve 72 downward to open the higher range thermostat valve 11b and simultaneously pushing the second bypass valve 82 to close the second branch bypass passage 25b.

A spring loaded valve 31 is provided selectively to bring the open ended lower range thermostat valve chamber 10a into communication with with the upper radiator passage 15 or to interrupt the communication between the lower range thermostat valve chamber 10a and the upper radiator passage 15. A pressure operated actuator 32 is provided above the thermostat valve housing T to cooperate with the valve 31. A steel stem 33 of the actuator 32, which supports the valve 31 at its distal end and is secured to a diaphragm 33a at its top end, is slidably air-tightly supported by a top wall of the thermostat valve housing T for vertical movement. The actuator 32 forms therein a pressure chamber 34 in which a coil spring 33b is disposed between the diaphragm 33a and the bottom of the actuator 32 and surrounds the upper portion of the steel stem 33.

A three-way solenoid valve 36, which is electrically controlled by means of a central processing unit (CPU) 51, is connected between the actuator 32 and an intake manifold 62 by way of a connecting pipe 35. The connecting pipe 35 is provided with a diaphragm 35a between the three-way solenoid valve 36 and the actuator 32 and a check valve 37 between the three-way solenoid valve 36 and the intake manifold 62 so that the passage of negative pressure and the passage of the atmospheric pressure are selectively connected to or cut off from the pressure chamber 34 of the actuator 32. The three-way solenoid valve 36 opens, in one way, under low engine load conditions, to let a negative pressure act in the pressure chamber 34 of the actuator 32 so as to force the valve 31 downward, closing the top opening of the thermostat valve chamber 10a to cut off the passage of engine coolant through the valve chamber 10a. The three-way solenoid valve 36 opens, in another way, under high engine load conditions, to introduce the atmospheric pressure into the pressure chamber 34 of the actuator 32 so as to move the diaphragm 33a upward, thus pulling the valve 31 open and allowing engine coolant to flow through the valve chamber 10a on into the upper radiator passage 15.

The three-way solenoid valve 36 is also controlled to introduce the atmospheric pressure into the pressure chamber 34 of the actuator 32, moving the diaphragm 33a upward, so as to cause the valve 31 to open when the engine coolant is at a temperature of approximately 108° C. (226.4° F.) even when the engine ER is operated in the low engine load range.

A thin or flat radiator 16 comprises a radiator core 18 having a tube and corrugated fin construction, and top or upper and bottom or lower radiator tanks 17 and 19 disposed at the top and bottom of the radiator core 18, respectively. The open ended thermostat valve chambers 10a and 10b are communicated with the upper radiator tank 17 by way of a top or upper radiator passage 15. Similarly, the water inlet 13 of the water pump 7 is communicated with the lower radiator tank 19 by way of a bottom or lower radiator passage 24. The top of the upper tank 17 is provided with a filler neck 20 closed with a removable radiator pressure cap 21. To speed up cooling action of the radiator 16, an engine or electrically driven fan 23 is used to draw air through the radiator core 18. The fan 23 is set back from the radiator core 18 and it will possibly recirculate the same air. To avoid the loss of fan efficiency, a radiator shroud 22 is disposed to surround the fan 23 so as to prevent circulation of air.

Engine coolant leaving the engine ER, which is quite hot, enters into the upper tank 17 of the radiator 16. From the upper tank 17, the engine coolant flows down through tiny copper tubes having thin copper fins soldered over their entire length. As the engine coolant makes its way down through the tubes, it gives off heat to the tubes which also give off their heat, via the thin copper fins, to the air passing around the tubes. By the time the engine coolant reaches the radiator lower tank 19, it will be cool enough to reuse. The cooled engine coolant is circulated through the engine ER by the aid of the water pump 7.

The engine ER is provided with a pipe 28 at the rear upper end thereof. The pipe 28 is connected to the upstream end of the hot area 5a of the water jacket 5 to allow the engine coolant to enter a turbo-charger (TC) well known in the art. Heat-absorbed engine coolant from the turbo-charger (TC) reenters the lower radiator passage 24 at a position upstream the water pump 7 through a return pipe 29.

A temperature sensor 50 is provided in the outlet passage 12 close to the lower range thermostat valve 10a to output a signal $S_w$ representing the temperature of the engine coolant flowing through the outlet passage 12 to the CPU 51. Signals $S_v$ and $S_s$, respectively representing engine load and engine speed, are output to the CPU 51 from an engine load sensor and an engine speed sensor. These sensors are well known to those skilled in the art and need not be shown and explained therein.

CPU 51 is associated with a ROM 52 and a RAM 53. The ROM stores therein an operation program for independently controlling the three-way solenoid valves 36. The RAM 53 stores engine load data, engine speed data and temperature data necessary to control the three-way solenoid valves 36 following the operation program.

The cooling system thus constructed can provide different circulations of engine coolant: a cooling circulation running through the water pump 7, the water jacket 5 of the engine ER, the thermostat valve chambers 10a and/or 10b, and the radiator 16; and a bypass circulation running through the water pump 7, the water jacket 5 of the engine ER, the lower space T2 of the thermostat valve housing T and the bypass passage 14.

Figure 3A:
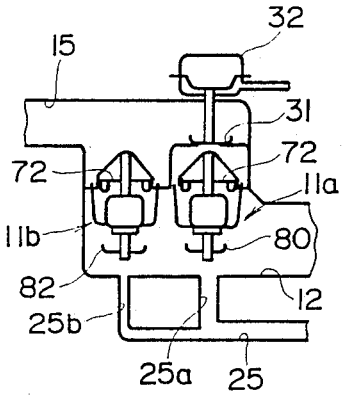
FIGS. 3A through 3D are illustrations showing thermostat action in various stages.

When the engine ER is cool or is operated in low engine temperature range, the lower range thermostat valve 11a, the higher range thermostat valve 11b and the valve 31 are all maintained closed, but the first and second bypass valve 80 and 82 are maintained open as shown in FIG. 3A until the engine coolant in the engine ER reaches the specific temperature or opening temperature of 82° C. of the lower range thermostat valve 11a. Therefore, until the opening temperature of 82° C. of the lower range thermostat valve 11a is reached, the engine coolant leaving the engine ER flows on at a high rate to circulate through the outlet passage 12, the first and second branch bypass passages 25a and 25b, the water inlet 13, the water pump 7, the inlet passage 9, the water jacket 5 of the engine ER, without passing through the radiator 16, thereby the engine ER is prevented from running too cool.

When the engine coolant reaches the opening temperature of 82° C. of the low range thermostat valve 11a, the wax pellet 71 of the lower range thermostat valve 11a is heated. This causes the wax to expand and force the rubber tightly against the steel piston 73 of the lower range thermostat valve 11a, so that the lower range thermostat valve 11a starts opening, but the higher range thermostat valve 11b remains closed. If the engine ER is operated in low engine load condition, the CPU 51 actuates the three-way solenoid valve 36 to hold the valve 31 closed, whereby the thermostat valve chamber 10a is not communicated with the upper radiator passage 15. The first and second branch bypass passages 25a and 25b are still maintained in communication with the water inlet 13 of the water pump 7, still permitting the engine coolant to take the bypass circulation through the engine ER running through the outlet passage 12, the first and second branch bypass passages 25a and 25b, the water inlet 13, the water pump 7, the inlet passage 9, the water jacket 5 of the engine ER, without passing through the radiator 16, whereby the engine ER is prevented from running too cool.

Figure 3B:
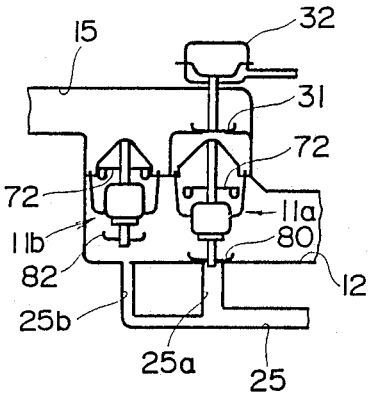

In the low engine load range where the valve 31 is maintained closed, when the engine coolant reaches about 87° C., the lower range thermostat valve **11*b* further opens sufficiently to press down the first bypass valve 80 against the bottom of the thermostat valve housing T, closing the first branch bypass passage 25*a*. At this time, the higher range thermostat valve 11*b* makes no action, maintaining the pull-push valve 72 of the higher range thermostat valve 11*b* closed and the second branch bypass passage 25*b* opened, whereby the engine coolant leaving the engine ER still flows on, but at a relatively low rate, to circulate through the outlet passage 12, the second branch bypass passage 25*b*, the water inlet 13, the water pump 7, the inlet passage 9, the water jacket 5 of the engine ER, without passing through the radiator 16**, as shown in FIG. 3B. Thus, the engine ER is kept hot or at an efficient operating temperature, so as to contribute to or aid an increase of fuel mileage and the emission control in the low engine load range.

Figure 3C:
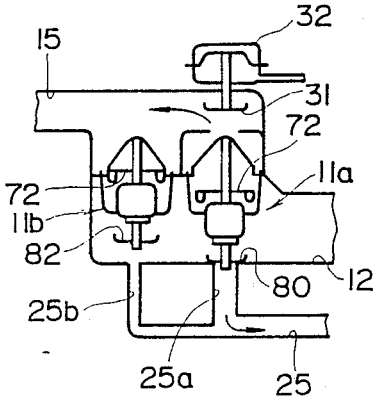
Figure 3D:
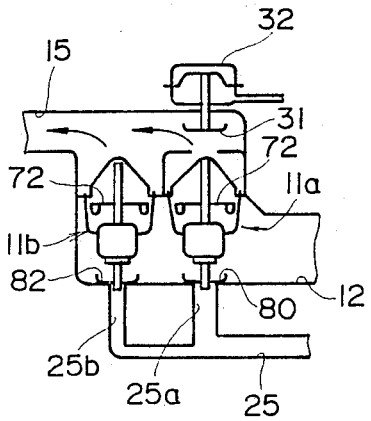

When the engine ER is put under a rapid acceleration, the CPU 51 actuates the solenoid valve 36 so as to cause the valve 31 to open as shown in FIG. 3C. This causes a greater part of the engine coolant leaving the engine ER to flow through the lower range thermostat valve **11*a* into the upper radiator passage 15 to the radiator 16, whereby the engine coolant is cooled and pumped back into the water jacket 5 of the engine ER, so as to cool efficiently the engine ER. It is to be understood that whereas the engine coolant leaving the engine ER partly takes the bypass circulation into the engine ER through the second branch bypass passage 25*b*, nevertheless, it is too small to result in cooling loss. When the engine coolant temperature reaches 95° C., the low range thermostat valve 11*a* is fully opened, permitting a greater part of the engine coolant leaving the engine ER to flow therthrough As the engine ER, and hence the engine coolant, heats and reaches nearly the specific temperature or opening temperature of 97° C. of the higher range thermostat values 11*b* while the engine ER is under a rapid acceleration, the wax pellet 71 of the higher range thermostat valve 11*b* is heated. This causes the wax gradually to expand and force the rubber tightly against the steel piston 73 of the higher range thermostat valve 11*b* and the higher range thermostat valve 11*b* will be gradually pulled opened, accordingly. During the gradual opening of the higher range thermostat valve 11*b*, the CPU 51 controls the three-way solenoid valve 36 to maintain the valve 31 to open the thermostat valve chamber 10*a*. The engine coolant is allowed to flow through the lower range thermostat valve 11*a*, this valve having been fully opened, and the thermostat valve chamber 10*a* into the upper radiator passage 15. When the engine coolant temperature reaches near 102° C., five degrees higher than the opening temperature of the higher range thermostat valve 11*b*, the wax will have expand expanded to the point that the pressure on the steel piston 73 is so great that it will force the case 70 to press down the second bypass valve passage 82 against the bottom of the thermostat valve housing T, whereby the second bypass valve 82 closes the second branch bypass passage 25*b* and interrupts any part of the engine coolant leaving the engine ER to flow into the second branch bypass passage 25*b*** as shown in FIG. 3D.

If the engine coolant temperature reaches around 108° C. while the engine is operated in the low engine load range, the CPU 51 causes the solenoid valve 36 to force the actuator 32 to open the valve 31 for preventing the engine ER from being overheated.

When the engine coolant temperature reaches the specific temperature of 110° C. and the high range thermostat valve **11*b* is fully opened, the engine coolant leaving the engine ER takes the cooling circulation running through the thermostat valves 11*a* and 11*b*, the radiator 16, the water pump 7, and the water jacket 5** of the engine ER. This cooling circulation of the engine coolant is effected at a high rate, so that engine cooling is performed with a high efficiency in high temperature engine operating range.

The invention has been described in detail with particular reference to preferred embodiments thereof, but the pellet thermostat valves **11*a* and 11*b* can be disposed in the lower radiator passage 24 and replaced with bellows type thermostat valves. Furthermore, the pressure-controlled actuators 32 and 44** can be replaced with any known electromagnetic plungers.

It should be noted that various changes and modifications are apparent to those skilled in the art which are within the scope of the invention, and such changes and modifications are intended to be covered by the following claims.

What is claimed is:

1. A cooling system for an internal combustion engine having a radiator connected to said engine by way of a circulation passage for cooling and circulating engine coolant through said engine, said cooling system comprising:

first and second valve means disposed in parallel to each other in said circulation passage, said first valve means being adapted to be open at temperatures higher than a first predetermined opening temperature at which said first valve means starts opening while said engine is operated in high engine load range, and said second valve means being adapted to start opening at a second predetermined opening temperature higher than said first predetermine opening temperature for said first valve means;

at least one bypass passage branching off from said circulation passage for allowing engine coolant leaving said engine to reenter into said engine while bypassing said radiator; and bypass valve means for closing said at least one bypass passage at a temperature between said first and second predetermined opening temperatures for said first and second valve means

2. A cooling system as defined in claim 1, wherein said at least one bypass passage has a cross-sectional area larger than that of any other bypass passage.

3. A cooling system as defined in claim 2, wherein said first valve means includes a first thermostat valve starting opening at said first predetermined opening temperature and said bypass valve means is coupled with said first thermostat valve to close said at least one bypass passage while said first thermostat valve is opening.

4. A cooling system as defined in claim 2, wherein said first valve means comprises a first thermostat valve starting opening at said first predetermined opening temperature to permit engine coolant to flow therethrough and a load valve located in series relative to said first thermostat valve in said circulation passage, said load valve being operated by actuator means to close for interrupting said flow of engine coolant through said first thermostat valve when said engine is operated in a low engine load range.

5. A cooling system, as defined in claim 4, wherein said actuator means comprises an air operated actuator and a three-way valve through which said air operated actuator is connected to an intake manifold of said engine, said three-way valve operating to introduce into said air operated actuator a negative pressure so as to close said load valve when said engine is operated in said low engine load range or the atmospheric pressure to open said load valve when said engine is operated in said high engine load range.

6. A cooling system as defined in claim 4, wherein said load valve is disposed downstream said first thermostat valve in said circulation passage and said bypass valve is coupled with said first thermostat valve to close said at least one bypass passage while said first thermostat valve is opening.

7. A cooling system as defined in claim 1 wherein said bypass valve means if forced to close said at least one bypass passage at a temperature a predetermined degree higher than said predetermined opening temperature for said at least one valve means independently of engine load.

8. A cooling system as defined in claim 7, wherein said first valve means comprises a first thermostat valve starting opening at said first predetermined opening temperature to permit engine coolant to flow therethrough and being fully opened at a first predetermined full opening temperature lower than said second predetermined opening temperature, and a valve located in series relative to said first thermostat valve in said circulation passage, said load valve being operated by an actuator means to close for interrupting said flow of engine coolant through said first thermostat valve when said engine is operated in a low engine load range.

9. A cooling system as defined in claim 8, wherein said first thermostat valve starts opening near 82° C. and is fully opened around 95° C.

10. A cooling system as defined in claim 8, wherein said second valve means starts opening near 97° C. and is fully opened around 110° C.

11. A cooling system as defined in claim 8, wherein said bypass valve means closes said at least one bypass passage around 87° C.

12. A cooling system as defined in claim 8, wherein said load valve of said first valve means is forced to open around 108° C.

13. A cooling system for an internal combustion engine having a radiator connected to said engine by way of a circulation passage for cooling and circulating engine coolant through said engine, said cooling system comprising:

first valve means disposed in said circulation passage, said first valve means comprises a first thermostat valve starting opening at a first predetermined opening temperature to permit engine coolant to flow therethrough and a load valve located in series relative to said first thermostat load valve in said circulation passage, said valve being operated by actuator means to close for interrupting said flow of engine coolant through said first thermostat valve when said engine is operated in a low engine load range;

second valve means comprising of a second thermostat valve disposed parallel to said first thermostat valve in said circulation passage, said second thermostat valve being adapted to start opening at a second predetermined opening temperature higher than said first predetermined opening temperature for said first valve means;

a first bypass passage branching off from said circulation passage for allowing engine coolant leaving said engine to reenter into said engine while bypassing said radiator;

a second bypass passage branching off from said circulation passage for allowing engine coolant leaving said engine to reenter into said engine while bypassing said radiator; and bypass valve means being cooperated with said first thermostat valve for closing said first bypass passage when said first thermostat valve is being opened.

14. A cooling system as defined in claim 13, wherein said first thermostat valve causes said bypass valve to open said first bypass passage after starting to open and before fully opening at a predetermined full opening temperature lower than said second predetermined temperature for said second thermostat valve.

15. A cooling system as defined in claim 13, further comprising a bypass valve coupled with said second thermostat valve for closing said second bypass passage when said second thermostat valve is being opened.

16. A cooling system as defined in claim 15, wherein said bypass valve coupled with said second thermostat valve is caused to close said second bypass passage at a temperature higher than a temperature at which said bypass valve cooperated with said first thermostat valve is caused to close said first bypass passage.

17. A cooling system a defined in claim 16, wherein said second bypass passage has a cross-sectional area smaller than that of said first bypass passage.

18. A cooling system as defined in claim 16, wherein said first thermostat valve starts opening near 82° C. and is fully opened around 95° C.

19. A cooling system as defined in claim 16, wherein said second valve means starts opening near 97° C. and is fully opened around 110° C.

20. A cooling system as defined in claim 16, wherein said bypass valve coupled with said first thermostat valve is caused to close said first bypass passage around 87° C.

21. A cooling system as defined in claim 16, wherein said bypass valve coupled with said second thermostat valve is caused to close said second bypass passage around 102° C.

22. A cooling system for an internal combustion engine having a radiator for cooling engine coolant leaving an engine and a water pump for circulating said engine coolant through said engine, said cooling system comprising:

an inlet radiator passage connecting said engine to said radiator, said inlet radiator passage being partly divided into first and second separate passages parallel to each other;

an outlet radiator passage in which said water pump is disposed;

a bypass passage connecting an upstream part of said inlet radiator passage where said first and second separate passages are formed to said outlet radiator passage for allowing engine while bypassing said radiator;

first valve means disposed in said first separate passage of said inlet radiator passage for permitting said engine coolant leaving said engine to flow through said first separate passage when said engine coolant is at temperatures higher than a first predetermined opening temperature and said engine is operated in low engine load range and interrupting said flow of engine coolant through said first separate passage when said engine is operated in a low engine load range;

second valve means disposed in said second separate passage for permitting said engine coolant leaving said engine to flow through said second separate passage when said engine coolant is at temperatures higher than a second predetermined temperature higher than said first predetermined opening temperature; and bypass valve means for closing said bypass passage when said engine coolant is at a temperature between said first and second predetermined opening temperatures.

23. A cooling system as defined in claim 22, wherein said first valve means comprises a first thermostat valve starting opening at said first predetermined opening temperature so as to permit said engine coolant to flow therethrough and a load valve located downstream said first thermostat valve in said first separate passage, said load valve being operated by actuator means to close said first separate passage when said engine is operated in said low engine load range so as to interrupt said flow of engine coolant through said first thermostat valve.

24. A cooling system as defined in claim 23, wherein said actuator means comprises an air operated actuator and a threeway valve through which said air operated actuator is connected to an intake manifold of said engine, said three-way valve operating to introduce into said air operated actuator a negative pressure so as to close said load valve when said engine is operated in said low engine, load range or the atmospheric pressure to open said load valve when said engine is operated in high engine load range.

25. A cooling system as defined in claim 24, wherein said first thermostat valve starts opening near 82° C. and is fully opened around 95° C.

26. A cooling system as defined in claim 24, wherein said bypass valve is caused to close said bypass passage at around 87° C.

27. A cooling system as defined in claim 22, wherein said second valve means comprises a second thermostat valve located parallel to said first thermostat valve and being adapted to start opening at said second predetermined opening temperature.

28. A cooling system as defined in claim 27, wherein said second valve means further comprises a bypass valve coupled with said second thermostat valve to close said bypass passage for interrupting said circulation of engine coolant through said bypass passage when said second thermostat valve is opening.

29. A cooling system as defined in claim 28, wherein said second thermostat valve starts opening near 97° C. and is fully opened around 110° C.

30. A cooling system as defined in claim 28, wherein said second thermostat valve causes said bypass valve coupled with said second thermostat valve to close said bypass passage at around 102° C.

31. A cooling system for an internal combustion engine having a radiator for cooling engine coolant leaving an engine and a water pump for circulating said engine coolant through said engine, said cooling system comprising:

an inlet radiator passage connecting said engine to said radiator, said inlet radiator passage being partly divided into first and second separate passages parallel to each other;

an outlet radiator passage in which said water pump is disposed;

a first bypass passage connecting an upstream part of said inlet radiator passage where said first and second separate passages are formed to said outlet radiator passage for allowing engine coolant leaving said engine to reenter into said engine while bypassing said radiator;

a second bypass passage connecting said upstream part of said inlet radiator passage to said outlet radiator passage for allowing engine coolant leaving said engine to reenter into said engine while bypassing said radiator, said second bypass passage having a cross-sectional area smaller than that of said first bypass passage;

first valve means disposed in said first separate passage of said inlet radiator passage for permitting said engine coolant leaving said engine to flow through said first separate passage when said engine coolant is at temperatures higher than a first predetermined opening temperature and said engine is not operated in low engine load range and interrupting said flow of engine coolant through said first separate passage when said engine is operated in said low engine load range;

second valve means disposed in said second separate passage for permitting said engine coolant leaving said engine to flow through said second separate passage when said engine coolant is at temperatures higher than a second predetermined temperature higher than said first predetermined opening temperature; and bypass valve means coupled with said first valve means for closing said first bypass passage when said engine coolant is at a temperature between said first and second predetermined opening temperatures.

32. A cooling system as defined in claim 31, wherein said first valve means comprises a first thermostat valve starting opening at said first predetermined opening temperature so as to permit said engine coolant to flow therethrough and a load valve located downstream said first thermostat in said first separate passage, said load valve being operated by actuator means to close said first separate passage when said engine is operated in said low engine load range so as to interrupt said flow of engine coolant through said first thermostat valve.

33. A cooling system as defined in claim 32, wherein said first thermostat valve starts opening near 82° C. and is fully opened around 95° C.

34. A cooling system as defined in claim 32, wherein said bypass valve is caused to close said bypass passage at around 87° C.

35. A cooling system as defined in claim 31, wherein said second valve means comprises a second thermostat valve located parallel to said first thermostat valve and being adapted to start opening at said second predetermined opening temperature.

36. A cooling system as defined in claim 35, wherein said second valve means further comprises a bypass valve coupled with said second thermostat valve to close said second bypass passage when said second thermostat valve is opening.

37. A cooling system as defined in claim 36, wherein said second thermostat valve starts opening near 97° C. and is fully opened around 110° C.

38. A cooling system as defined in claim 36, wherein said second thermostat valve causes said bypass valve coupled with said second thermostat valve to close said second bypass passage at around 102° C.

* * * * *